US009296203B2

(12) United States Patent
Iftime et al.

(10) Patent No.: US 9,296,203 B2
(45) Date of Patent: Mar. 29, 2016

(54) OPTICALLY SWITCHABLE COMPOSITION FOR AQUEOUS TRANSFIX BLANKET

(71) Applicant: XEROX CORPORATION, Norwalk, CT (US)

(72) Inventors: Gabriel Iftime, Mississauga (CA); Carolyn Moorlag, Mississauga (CA); Sarah Vella, Milton (CA); Barkev Keoshkerian, Thornhill (CA); Michelle N. Chretien, Mississauga (CA)

(73) Assignee: XEROX CORPORATION, Norwalk, CT (US)

( * ) Notice: Subject to any disclaimer, the term of this patent is extended or adjusted under 35 U.S.C. 154(b) by 288 days.

(21) Appl. No.: 14/035,056

(22) Filed: Sep. 24, 2013

(65) Prior Publication Data

US 2015/0085041 A1 Mar. 26, 2015

(51) Int. Cl.

| | |
|---|---|
| ***B41M 5/52*** | (2006.01) |
| ***B41J 2/005*** | (2006.01) |
| ***B41J 2/01*** | (2006.01) |

(52) U.S. Cl.

CPC ..... *B41J 2/0057* (2013.01); *B41J 2/005* (2013.01); *B41J 2/01* (2013.01); *B41M 5/52* (2013.01); *B41M 5/529* (2013.01); *B41M 2205/10* (2013.01); *Y10T 428/31663* (2015.04)

(58) Field of Classification Search

CPC .... B41M 5/52; B41M 5/529; B41M 2205/10; B41J 2/005; B41J 2/0057; B41J 2/01; B41J 2002/012

USPC ..... 428/32.12, 447; 347/103

See application file for complete search history.

(56) References Cited

U.S. PATENT DOCUMENTS

| | | | | |
|---|---|---|---|---|
| 5,389,958 | A | 2/1995 | Bui et al. | |
| 6,593,049 | B1 | 7/2003 | Veregin et al. | |
| 6,756,176 | B2 | 6/2004 | Stegamat et al. | |
| 6,830,860 | B2 | 12/2004 | Sacripante et al. | |
| 7,329,476 | B2 | 2/2008 | Sacripante et al. | |
| 7,494,757 | B2 | 2/2009 | Sacripante et al. | |
| 7,695,884 | B2 | 4/2010 | Vanbesien et al. | |
| 7,749,673 | B2 | 7/2010 | Zhou et al. | |
| 7,968,266 | B2 | 6/2011 | Field et al. | |
| 8,192,913 | B2 | 6/2012 | Faucher et al. | |
| 8,696,105 | B1 * | 4/2014 | Moorlag | G03G 15/161 347/103 |
| 8,696,106 | B1 * | 4/2014 | Moorlag | G03G 15/161 347/103 |
| 2010/0330305 | A1 | 12/2010 | Wu | |
| 2011/0104499 | A1 | 5/2011 | Wu et al. | |
| 2011/0244202 | A1 | 10/2011 | Wu et al. | |
| 2011/0244247 | A1 | 10/2011 | Wu et al. | |
| 2012/0049121 | A1 | 3/2012 | Wu | |

OTHER PUBLICATIONS

Yang et al., "Photon Control of Liquid Motion on Reversibly Photoresponsive Surfaces," Langmuir, vol. 23, pp. 10864-10872, 2007.

Sun et al., "Reversible Switching Between Superhydrophilicity and Superhydrophobicity," Angew. Chem. Int. Ed., vol. 43, pp. 357-360, 2004.

* cited by examiner

*Primary Examiner* — Bruce H Hess

(74) *Attorney, Agent, or Firm* — Pillsbury Winthrop Shaw Pittman LLP

(57) ABSTRACT

An intermediate transfer member containing a blend of materials including a base polymer and a stimulus-responsive additive, an intermediate transfer member containing a first layer including a base polymer and a second layer grafted onto the first layer and including a stimulus-responsive additive, and a method of printing an image to a substrate.

16 Claims, 3 Drawing Sheets

OPTICALLY SWITCHABLE COMPOSITION FOR AQUEOUS TRANSFIX BLANKET

TECHNICAL FIELD

The present disclosure is generally related to indirect printing methods, and more specifically, to intermediate transfer members and printing processes involving intermediate transfer members.

BACKGROUND

Indirect printing methods generally include a two-step printing process including applying ink imagewise onto an intermediate transfer member, such as a drum or a belt, using an inkjet printhead, and then transferring a transient image to a substrate. After the ink is applied imagewise onto the intermediate transfer member, the ink wets or spreads on the intermediate transfer member to form a transient image. The transient image undergoes a change in properties, such as partial or complete drying, thermal or photo-curing or gelation, and is then transferred to the substrate.

Intermediate transfer members, also known as transfix belts or transfer blankets, for use in an indirect printing method are designed to satisfy a range of requirements, including wetting aqueous ink drops, heat absorption for water removal, and transfer of dried ink to the final substrate to give a clean plate.

Particularly, intermediate transfer members for use in indirect printing must meet specific sub-system requirements that are unique to the inkjet/transfix printing architecture. The intermediate transfer member desirably exhibits surface properties, such as energy, topology, and so forth, to enable wetting of the ink and subsequently, such as after the phase-change, to enable complete transfer of the transient image onto a substrate. Generally, intermediate transfer member materials that display good wettability do not sufficiently transfer the ink film onto a substrate, or conversely, do not sufficiently wet the ink but do transfer efficiently to the substrate.

SUMMARY

Provided is an intermediate transfer member comprising a blend of materials comprising a base polymer; and a stimulus-responsive additive.

Also provided is an intermediate transfer member comprising a first layer comprising a base polymer; and a second layer grafted onto the first layer and comprising a stimulus-responsive additive.

Additionally provided is a method of printing an image to a substrate comprising applying an ink onto an intermediate receiving member using an inkjet printhead; spreading the ink onto the intermediate receiving member; inducing a property change of the ink; and transferring the ink to a substrate, wherein the intermediate transfer member comprises a base polymer and a stimulus-responsive additive.

EMBODIMENTS

Figure 1:
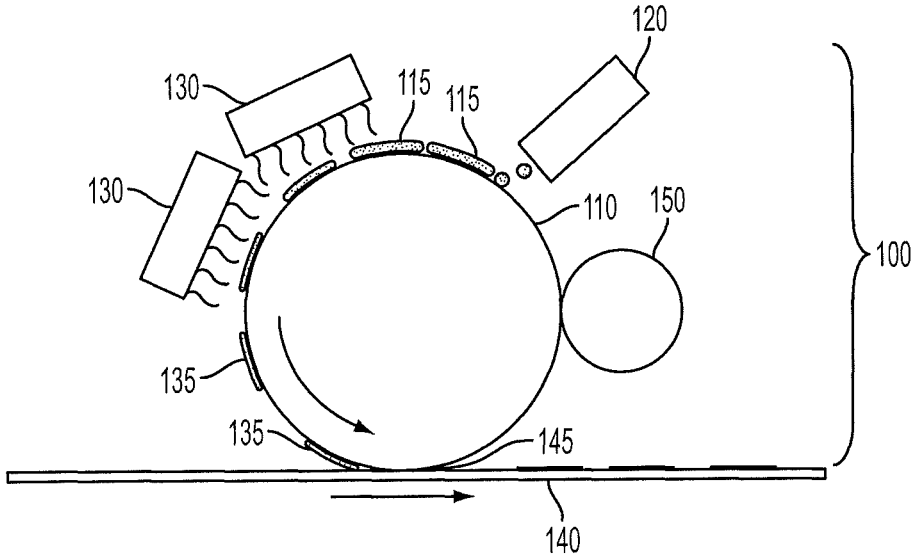
FIG. 1 is a schematic representation of a two-step printing process.

In this specification and the claims that follow, singular forms such as "a," "an," and "the" include plural forms unless the content clearly dictates otherwise. All ranges disclosed herein include, unless specifically indicated, all endpoints and intermediate values. In addition, reference may be made to a number of terms that shall be defined as follows:

"Optional" or "optionally" refer, for example, to instances in which subsequently described circumstances may or may not occur, and include instances in which the circumstance occurs and instances in which the circumstance does not occur.

The phrases "one or more" and "at least one" refer, for example, to instances in which one of the subsequently described circumstances occurs, and to instances in which more than one of the subsequently described circumstances occurs.

As used herein, the modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range "from about 2 to about 4" also discloses the range "from 2 to 4."

"Room temperature" refers to a temperature of from about 20° C. to about 30° C., such as from about 20° C. to about 24° C., or from about 23° C. to about 27° C., or from about 26° C. to about 30° C.

"Lower surface free energy" refers to a surface with reduced polar behavior when compared to a "higher surface free energy" surface. A lower surface free energy surface has reduced ability of being wetted by a liquid with a surface tension higher than the surface free energy of the surface. Generally, the lower surface free energy surface is not wetted by the liquid ink used herein. The ink used herein wets the higher surface free energy surface. For example, a lower surface free energy may be in a range of from about 10 to about 25 dyne/cm, or from about 10 to about 20 dyne/cm, or from about 15 to about 25 dyne/cm. A higher surface free energy may be in a range of from about 25 to about 70 dyne/cm, or from about 25 to 50 dyne/cm, or from about 35 to about 70 dyne/cm. As an illustrative example, a liquid ink having a surface tension of 30 dyne/cm will wet poorly a lower surface free energy coating having a surface energy such as 20 dyne/cm, but the liquid ink will wet well a high surface free energy coating having a surface energy such as 40 dyne/cm.

"Predetermined critical wavelength" refers to a wavelength at which a surface switches between two states having different surface free energy. Generally, a switchable surface as described herein requires two predetermined critical wavelengths. A first predetermined critical wavelength refers to a wavelength that induces change from a first low polarity state or low surface free energy surface to a second more polar or higher surface free energy surface. For example, the first predetermined critical wavelength of an intermediate transfer member may be from about 100 to about 500 nm, such as from about 200 to about 450 nm, or from about 250 to about 450 nm, or from about 300 to about 400 nm. A second predetermined critical wavelength refers to a wavelength that induces the opposite change from a second more polar or higher surface free energy surface to a first low polarity state or low surface free energy surface. For example, the second predetermined critical wavelength of an intermediate transfer member may be from about 350 to about 1500 nm, such as from about 400 to about 800 nm, or from about 400 to about 700 nm.

An intermediate transfer member of this disclosure comprises a base polymer and a stimulus-responsive additive. The base polymer and the stimulus-responsive additive may be present in the intermediate transfer member in a blend of materials, or the base polymer and the stimulus-responsive material may be present in the intermediate transfer member in a first layer and a second layer, respectively, wherein the second layer is grafted onto the first layer. Using such a configuration in an intermediate transfer member results in an intermediate transfer member having suitable wetting and transfer properties.

Indirect Printing

Images may be applied to a substrate using a two-step printing process. An exemplary offset or indirect printing process is disclosed in U.S. Pat. No. 5,389,958, the entire disclosure of which is totally incorporated herein by reference.

Figure 2:
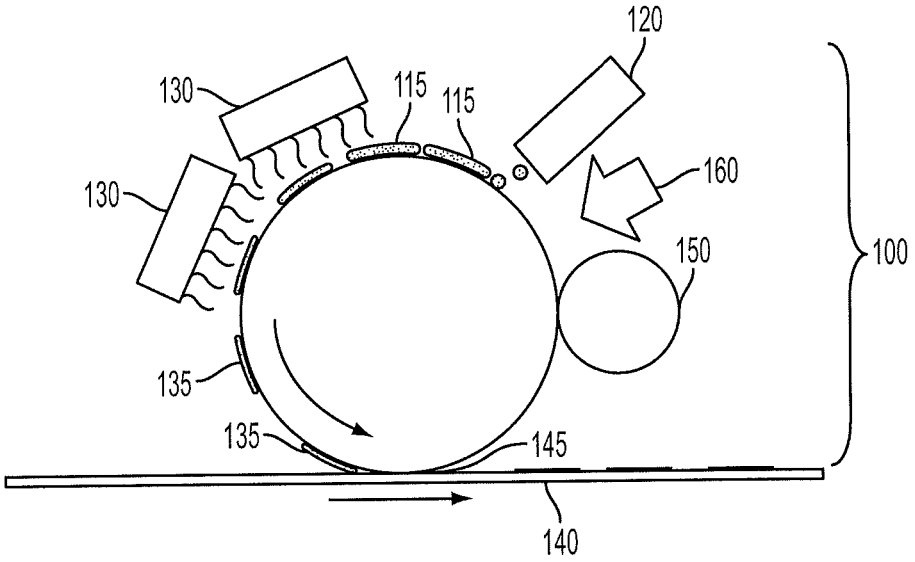
FIG. 2 is a schematic representation of an alternative two-step printing process.

As shown in FIG. 1, a two-step printing process may include applying an ink imagewise onto an intermediate transfer member 110, such as a drum or a belt, using an inkjet printhead 120, wetting/spreading the ink on the intermediate transfer member 110 to form the transient image 115, inducing a property change in the transient image using a property-change device 130, and transferring the post-phase-change transient image 135 to the substrate 140. The substrate 140 may be fed to a nip region 145 in the direction of the arrow. A cleaning unit 150 may clean the intermediate transfer member 110 of any residual ink, dust, or other materials after transfer of the ink images has been completed. As shown in FIG. 2, a two-step printing process may additionally include inducing the energy state of the intermediate transfer member 110 using a UV station 160.

An indirect printing process may use an intermediate transfer member including (i) a polymer composition containing a stimulus-responsive additive dispersed in a base polymer matrix, or (ii) a first layer containing a base polymer and a second layer containing a stimulus-responsive additive, wherein the second layer is grafted onto the first layer, resulting in the surface free energy of the polymer composition being capable of reversibly adjusting from a first surface free energy state to a second surface free energy state when exposed to light of a predetermined wavelength. Thus, the surface free energy of the intermediate transfer member may be adjusted by exposing the intermediate transfer member to a stimulus. For example, the surface free energy of the intermediate transfer member may be reversibly adjusted from a first surface free energy state to a second surface free energy state by exposing the polymer composition to a predetermined UV wavelength.

For example, when the wavelength of the light is less than a predetermined critical wavelength, the intermediate transfer member may switch from a relatively lower surface free energy state to a relatively higher surface free energy state. When the wavelength of the light is greater than a predetermined critical wavelength, the intermediate transfer member may switch from a relatively higher surface free energy state to a relatively lower surface free energy state. Thus, the surface free energy of the polymer composition may be switched reversibly and controllably between two states—a higher surface free energy state and a lower surface free energy state—when exposed to different wavelengths. The lower surface free energy state may enable transfer while the higher surface free energy state may enable spreading (wetting). Specifically, when the intermediate transfer member is in a higher surface free energy state, the intermediate member may also have a higher polarity than when the intermediate transfer member is in a lower surface free energy state. A surface free energy state that enables the spreading (wetting) step may have a surface free energy that is greater than the surface tension of the liquid ink, while a surface free energy state that enables transfer may have a surface free energy that is lower than the surface free energy of the dry (resin) ink.

Particularly, the intermediate transfer member may be uniformly illuminated with UV light of an appropriate wavelength prior to jetting to switch the surface of the intermediate transfer member to the higher surface energy/higher polarity state, which may favor ink wetting onto the surface, therefore resulting in improved ink spread. The ink may then be transferred from the intermediate transfer member onto the substrate. The intermediate transfer member may be switched to its less polar isomer state using heat or, alternatively, by uniform illumination with a light of a wavelength greater than the first wavelength, particularly when the wavelength is capable of penetrating the ink film.

The surface free energy of the stimulus-responsive additive in the higher surface free energy state may be from about 25 to about 70 dynes/cm, such as from about 26 to about 42 dynes/cm, or from about 34 to about 60 dynes/cm, or from about 50 to about 70 dynes/cm. The lower surface free energy state may be, for example, from about 10 to about 25 dynes/cm, such as from about 10 to about 12 dynes/cm, or from about 8 to about 18 dynes/cm, or from about 14 to about 25 dynes/cm. Particularly, the difference between the lower surface free energy state and the higher surface free energy state may be greater than about 1, such as greater than about 10, or greater than about 20, such as a difference of from about 1 to about 60 dynes/cm, or from about 1 to about 30 dynes/cm, or from about 15 to about 40 dynes/cm, or from about 30 to about 60 dynes/cm.

Any suitable light source may be used to expose the intermediate transfer member to light. Suitable light sources for switching from the lower surface free energy state to the higher surface free energy state include UV light, such as black light lamps or UV LEDs; and visible light, for example available from visible light LED sources. Suitable light sources for switching from the higher surface free energy state to the lower surface free energy state include visible and infrared light sources, such as LEDs or flood light sources.

When the low polarity state is achieved by heat, suitable temperatures are comprised in a range from about 50° C. to about 200° C., such as from about 50° C. to about 120° C., or from about 80° C. to about 150° C., or from about 140° C. to about 200° C.

Intermediate Transfer Member

An intermediate transfer member suitable for the above-two step printing process desirably has surface properties (such as energy, topology, and so forth) both to enable wetting of the ink and to enable complete transfer of the transient image (residual ink film along with pigment) onto a substrate. For the ink to wet well (i.e., spread) onto the intermediate transfer member, the surface free energy of the intermediate transfer member is desirably higher than the surface tension of the liquid ink. For the ink to subsequently be transferred from the intermediate transfer member to the substrate, the surface free energy of the intermediate transfer member is desirably lower than the surface free energy of the dry (resin) ink. Thus, the surface free energy of the intermediate transfer member desirable for wetting the ink may be different from the surface free energy desirable for transferring the ink image to the substrate.

As a general matter, the wettability or spread of a liquid on a surface is governed by the forces of interaction between the liquid, the surface, and the surrounding air, and in particular the surface free energy, as relating to the surface chemistry and surface topology. Surface tension is a parameter that can be described as the interaction between the forces of cohesion and the forces of adhesion, which determines whether or not wetting, or the spreading of liquid across a surface, occurs.

Young's Equation, which defines the balance of forces caused by a wet drop on a dry surface, stipulates that:

$$\gamma_{SL}+\gamma_{LV}\cos\theta=\gamma_{SV}$$

where $\gamma_{SL}$=forces of interaction between a solid and liquid; $\gamma_{LV}$=forces of interaction between a liquid and surrounding air; $\gamma_{SV}$=forces of interaction between a solid and surrounding air; and $\theta$=contact angle of the drop of liquid in relation to the surface. Young's Equation also shows that, if the surface tension of the liquid is lower than the surface energy, the liquid wets the surface. The surface energy depends on several factors, such as the chemical composition and crystallographic structure of the solid, and in particular of its surface, the geometric characteristics of the surface and its roughness, and the presence of molecules physically adsorbed or chemically bonded to the solid surface.

Characterization of the wetting properties of an intermediate transfer member comprising the base polymer and the stimulus-responsive additive may be carried out by measuring the water droplet contact angle at a given temperature. The contact angle represents an average of the wetting performance of the polymer and the additive. When in the lower surface free energy state, an intermediate transfer member according to the instant disclosure may have a water contact angle of from about 90° to about 150°, such as from about 80° to about 110°, or from about 95° to about 135°, or from about 125° to about 150°. At or above the critical activation temperature, an intermediate transfer member may have a water contact angle of from about 10° to about 90°, such as from about 15° to about 80°, or from about 20° to about 70°.

The degree of wettability change (that is, the difference in wettability between the intermediate transfer member in the first surface free energy state and the second surface free energy state) may be adjusted through selection and concentration of the components of the intermediate transfer member. The intermediate transfer member may include from about 50 to about 95 wt % based on a total weight of the intermediate transfer member, such as from about 50 to about 70 wt %, or from about 60 to about 85 wt %, or from about 80 to about 90 wt %, of a polymer base material having a relatively low surface free energy (that is, in embodiments, having a fixed surface free energy of from about 3 to about 25 dynes/cm, such as from about 10 to about 23 dynes/cm, or from about 15 to about 20 dynes/cm), and, thus, the wetting of the surface may be switched between a less polar and a more polar state. The degree of wettability change may be controlled by selection of a particular base polymer matrix (i.e., a base polymer matrix having a desired surface free energy), as well as by adjustment of the concentration of the stimulus-responsive additive in the intermediate transfer member. The difference between the water contact angle in the first surface free energy state and the contact angle of the polymer composition in the second surface free energy state may be from about 5° to about 140°, such as from about 10° to about 100°, or from about 10° to about 60°.

Figure 3:
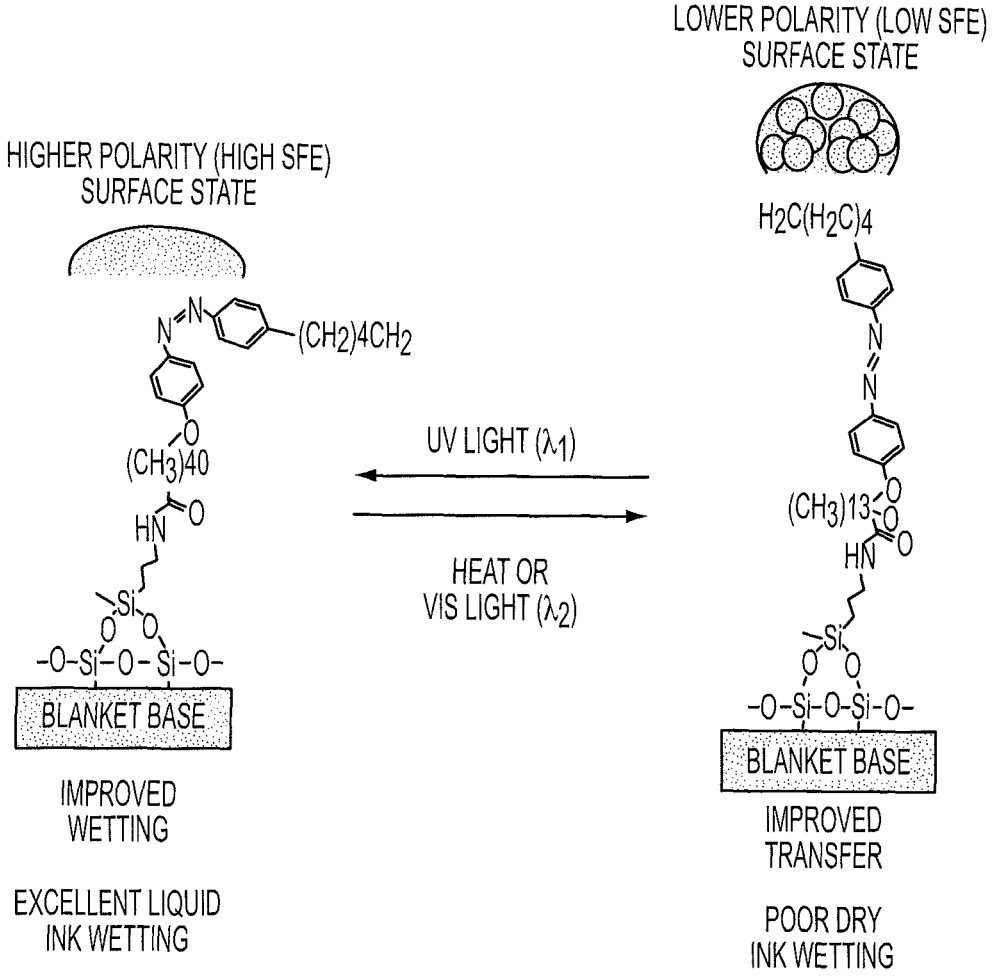
FIG. 3 exemplifies how the surface free energy and polarity of a material may switch from a first state to a second state.

As illustrated in FIG. 3, the surface free energy of the intermediate transfer member may be switched from a first surface free energy state to a second free energy state in response to a stimulus. For example, the surface free energy of the intermediate transfer member may be reversibly switched from a relatively higher surface free energy state to a relatively lower surface free energy state when exposed to light of a predetermined wavelength. The intermediate transfer member may be more polar at a first wavelength and less polar at a second wavelength.

Base Polymers

The base polymer may be any suitable material, such as those described in, for example, U.S. Patent Application Publication Nos. 2011/0244247, 2011/0104499, 2012/0049121, 2010/0330305, and 2011/0244202, the entire disclosures of which are totally incorporated herein by reference.

For example, the base polymer may be any material having a fixed surface free energy of from about 10 to about 40 dynes/cm, such as from about 15 to about 30 dynes/cm, or from about 14 to about 25 dynes/cm. The base polymer may have a water contact angle of greater than about 80°, or greater than about 100°, or greater than about 120°, such as from about 90° to about 135°, or from about 90° to about 115°, or from about 105° to about 125°, or from about 120° to about 135°.

Suitable materials for a base polymer matrix include low surface energy materials such as TEFLON™-like materials including fluorinated ethylene propylene copolymer (FEP), polytetrafluoroethylene (PTFE), polyfluoroalkoxy polytetrafluoroethylene (PFA TEFLON™), and like materials; silicone materials, such as fluorosilicones, and silicone rubbers, such as room temperature vulcanization (RTV) silicone rubbers, high temperature vulcanization (HTV) silicone rubbers, and low temperature vulcanization (LTV) silicone rubbers. These rubbers are known and readily available commercially, such as SILASTIC™ 735 black RTV and SILASTIC™ 732 RTV, both from Dow Corning; 106 RTV Silicone Rubber and 90 RTV Silicone Rubber, both from General Electric; and JCR6115CLEAR HTV and SE4705U HTV silicone rubbers from Dow Corning Toray Silicones. Other suitable silicone materials include the siloxanes (such as polydimethylsiloxanes); fluorosilicones (including partially fluorinated fluorosilicones and fully fluorinated fluorosilicones) such as Silicone Rubber 552, available from Sampson Coatings, Richmond, Va.; liquid silicone rubbers such as vinyl crosslinked heat curable rubbers or silanol room temperature crosslinked materials; and the like. Another specific example is Dow Corning Sylgard 182. Commercially available LSR rubbers include Dow Corning Q3-6395, Q3-6396, SILASTIC™ 590 LSR, SILASTIC™ 591 LSR, SILASTIC™ 595 LSR, SILASTIC™ 596 LSR, and SILASTIC™ 598 LSR from Dow Corning.

Suitable materials for a base polymer matrix may also include fluoroelastomers. Fluoroelastomers are from the class of 1) copolymers of two of vinylidenefluoride, hexafluoropropylene, and tetrafluoroethylene; 2) terpolymers of vinylidenefluoride, hexafluoropropylene, and tetrafluoroethylene; and 3) tetrapolymers of vinylidenefluoride, hexafluoropropylene, tetrafluoroethylene, and cure site monomer. These fluoroelastomers are known commercially under various designations such as VITON A™, VITON B™ VITON E™ VITON E 60C™, VITON E430™, VITON 910™, VITON GH™ VITON GF™, and VITON ETP™. The VITON™ designation is a Trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer, such as those commercially available from DuPont. Other commercially available fluoropolymers include FLUOREL 2170™, FLUOREL 2174™, FLUOREL 2176™, FLUOREL 2177™ and FLUOREL LVS 76™, FLUOREL™ being a registered trademark of 3M Company. Additional commercially available materials include AFLAS™, a poly(propylene-tetrafluoroethylene), and FLUOREL II™ (LII900), a poly(propylene-tetrafluoroethylenevinylidenefluoride), both also available from 3M Company, as well as the Tecnoflons identified as FOR-60KIR™, FOR-LHF™, NM. FOR-THF™, FOR-TFS™, TH™, NH™ P757™, TNS™, T439™, PL958™, BR9151™ and TN505™ available from Ausimont. The cure site monomer can be those available from E.I. DuPont de Nemours, Inc., such as 4-bromoperfluorobutene-1,1,1-dihydro-4-bromoperfluorobutene-1,3-bromoperfluoropropene-1,1,1-dihydro-3-bromoperfluoropropene-1, or any other suitable, known, commercially available cure site monomer.

The polymer base may be cross-linkable to provide a robust durable surface. The polymer base should be thermally stable to prolonged temperature exposure, such as temperatures from about 20° C. to about 200° C., or from about 30° C. to about 100° C., or from about 40° to about 60° C. The polymer base may be chemically stable when exposed to printing materials at the surface, such as ink components, water, and paper components, or other chemicals exposed at the surface during the printing process. Exposure of polymer base to printing materials may not result in contamination at the coating surface that limits print function.

Stimulus-Responsive Additive

The stimulus-responsive additive may be responsive to light. Suitable optically activated free energy switchable additives include additives that are capable of switching between a less polar state and a more polar state, as described in, for example, D. Yang et al., "Photon Control of Liquid Motion on Reversibly Photoresponsive Surfaces," *Langmuir*, 2007, 23, 10864-72, the entire disclosure of which is totally incorporated herein by reference. Particularly, the additive may switch from a lower polarity state to a higher polarity state when exposed to a wavelength of from about 200 to about 500 nm, or from about 200 to about 450 nm, or from about 250 to about 450 nm, or from about 300 to about 400 nm. The additive may switch from a higher polarity state to a lower polarity state when exposed to a wavelength of from about 400 to about 1500 nm, or from about 400 to about 800 nm, or from about 400 to about 700 nm.

Suitable optically activated surface free energy switchable additives include several classes of optically switching materials, including azobenzenes, spiropyrans, triphenylmethyl derivatives, and cinnamoyl derivatives. Particularly, the stimulus-responsive additive may include any of the following:

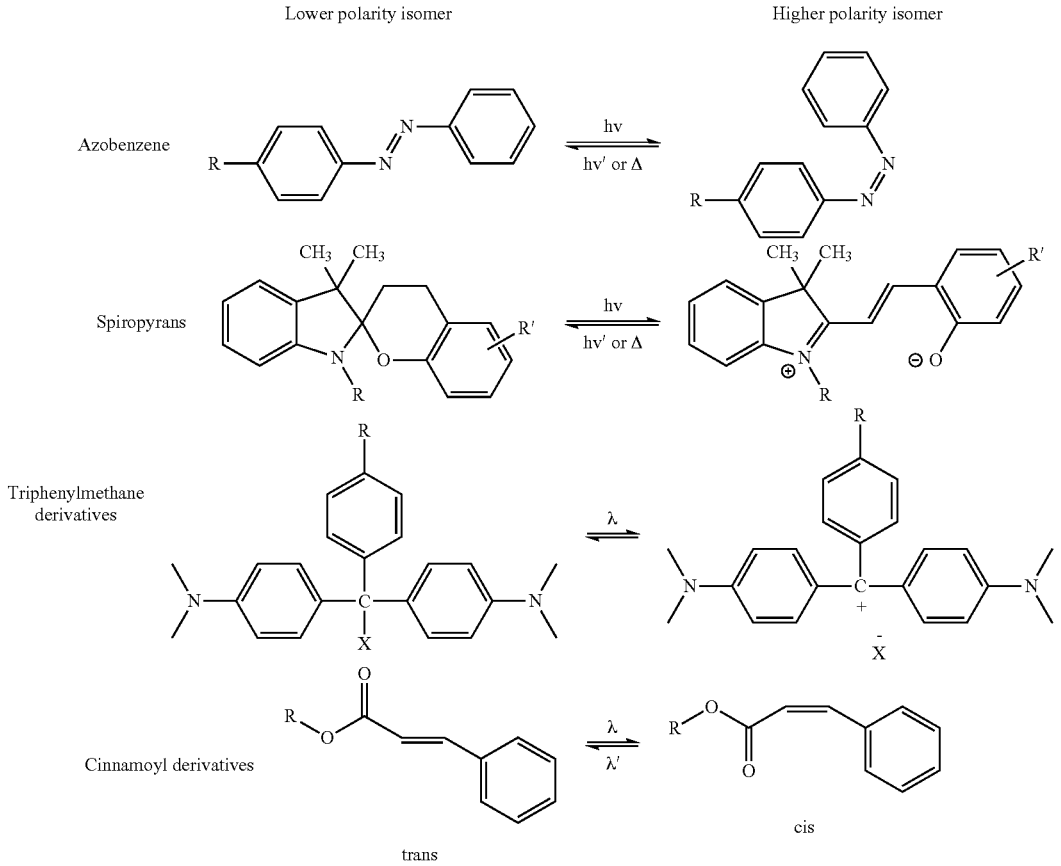

In the structures above, the R and R' groups may be an alkyl or aryl alkyl group containing from 1 to 20 carbon atoms. The alkyl group may be acyclic or cyclic. The R and R' groups may contain heteroatoms such as oxygen, nitrogen, sulfur, or phosphorus. Examples of suitable R and R' groups include methyl, ethyl, propyl, isopropyl, hexyl, ethyl-hexyl, phenyl, naphthyl. Examples of suitable R and R' containing heteroatoms include methoxy, ethoxy, nitro, carbonyl, carboxylic acid, and primary, secondary, or tertiary amines.

Switching from the lower polarity isomer to the higher polarity isomer is promoted by irradiation with UV light of an appropriate first wavelength, which is typically selected such as to overlap substantially with the high absorption wavelength of the molecule in the UV range of the spectrum. The reverse switching from the more polar to the less polar state may be activated by light with a longer second wavelength as compared to the first wavelength.

Particularly, the additive can switch from a lower polarity state to a higher polarity state when exposed to a wavelength of from about 200 to about 500 nm, or from about 200 to about 450 nm, or from about 250 to about 450 nm, or from about 300 to about 400 nm. The additive can switch from a higher polarity state to a lower polarity state when exposed to a wavelength of from about 400 to about 1500 nm, or from about 400 to about 800 nm, or from about 400 to about 700 nm.

Blend of Materials

An intermediate transfer member may include a polymer composition comprising a stimulus-responsive additive dispersed in a base polymer matrix, wherein the surface free energy of the polymer composition may be reversibly adjusted from a first surface free energy state to a second surface free energy state when exposed to light at a predetermined wavelength. In turn, because the additive is dispersed in a base polymer matrix to form the polymer composition, the additive, when incorporated into the polymer composition in an effective amount, imparts to the polymer composition as a whole the property of reversibly adjusting from a first surface free energy state to a second surface free energy state when exposed to a predetermined critical wavelength.

When the polymer and the additive are present as a blend of materials, the polymer may be present in the blend in an amount of from about 10 to about 99 wt % based on a total weight of the blend, such as from about 40 to about 99 wt %, or from about 50 to about 98 wt %, or from about 60 to about 98 wt %. Additionally, the stimulus-responsive additive may be present in the blend in an amount of from about 1 to about 80 wt % based on a total weight of the blend, such as from about 1 to about 70 wt %, or from about 2 to about 40 wt %, or from about 3 to about 30 wt %.

Using a blend for the composition of the intermediate transfer member may improve the ease of fabrication of the intermediate transfer member and reduce the cost associated with making the intermediate transfer member, as compared to producing an intermediate transfer member with grated layers. Additionally, the wear performance of the intermediate transfer member made with a blend of materials may be improved as compared to an intermediate transfer member comprising grafted layers.

Grafted Layers

An intermediate transfer member may include a first layer comprising the base polymer and a second layer grafted onto the first layer and comprising the stimulus-responsive additive. Specifically, the intermediate transfer member may comprise grafted small molecules or a grafted responsive polymer. The grafted layers may be produced by any suitable method, including those disclosed in T. Sun et al., "Reversible Switching Between Superhydrophilicity and Superhydrophobicity," *Angew. Chem. Int. Ed.* 2004, 43, 357-360, the entire disclosure of which is totally incorporated herein by reference.

The first layer may comprise a low surface free energy blanket or film. Suitable materials for the blanket or film include silicones, such as polydimethylsilioxane, partially fluorinated fluorosilicones, and fully fluorinated fluorosilicones; fluoropolymers, polytetrafluoroethylene (PTFE), and related partially and fully fluorinated polymeric fluorocarbons; specially fluorinated materials, such as fluorinated polyimide, and networked silioxyfluorocarbons.

The base polymer material may have a surface free energy in a range of from about 10 to about 40 dyne/cm. In this case, the surface free energy of the base polymer has a lesser influence of the achievable surface free energy of the lower and higher surface free energy states. The surface free energy is controlled generally by the first layer containing the responsive material which is grafted onto it. However, since over the course of extended operating time wear of the grafted surface is possible, it is preferred to use a base polymer layer with a surface free energy in a range not too far away from the low polarity surface. A suitable surface free energy for the base polymer material may be in a range from about 10 to about 30 dyne/cm.

When the intermediate transfer member comprises grafted layers of responsive small molecules, the surface free energy switch range may be higher. Additionally, the intermediate transfer member may respond to the light stimulus more quickly than when a blend of materials is used. When the intermediate transfer member comprises a grafted responsive polymer, the intermediate transfer member may respond to the light stimulus more quickly than when a blend of materials is used, but slower than when grafted responsive small molecules are used.

When the second grafted layer contains a responsive polymer, it may be fabricated from monomers selected from the group consisting of azobenzene or spiropyran switchable units, and units of polymerizable groups, which include vinyl groups.

Method of Making an Intermediate Transfer Member

A composition comprising a blend of materials comprising a base polymer and a stimulus-responsive additive may be prepared according to any suitable method. For example, the composition may be formed by mixing a suitable stimulus-responsive additive with suitable polymer precursor materials. Optionally, a solvent may be present in the mixture. The solvent may be beneficial in situations where the crosslinkable polymer precursor materials and the stimulus-responsive additive are not compatible. Examples of suitable solvents include tetrahydrofuran (THF), methylethylketone (MEK), cyclohexanone, and toluene. Mixing may be performed with a shaker, a blade, or magnetic stirrer. Alternatively, a second layer comprising a stimulus-responsive additive may be grafted onto a first layer comprising a base polymer according to any suitable method.

The intermediate transfer member may then be produced by blanket coating. Specifically, the intermediate transfer member may be cast or surface coated.

Casting involves pouring the composition into a mold, and then curing. The composition may be cured over a time period of from about 0.5 to about 6 hours, such as from about 0.5 to about 3 hours, or from about 1 to about 4 hours, or from about 3.5 to about 6 hours. The composition may be cured at an appropriate temperature, such as from about 90° C. to about 300° C., or from about 90° C. to about 250° C., or from about 120° C. to about 180° C., or from about 150° C. to about 200° C.

The composition may be deposited on a substrate. Any suitable substrate may be used, such as metals, rubbers, and fabrics. Suitable metals include steel, aluminum, nickel, and their alloys, and like metals and alloys of like metals. Suitable rubbers include ethylene propylene dienes, fluoroelastomers, n-butyl rubbers, silicone rubbers, other elastomers, and the like. A suitable fabric material refers to a textile structure comprised of mechanically interlocked fibers or filaments, which may be woven or nonwoven. Fabrics are materials made from fibers or threads and woven, knitted, or pressed into a cloth or felt type structures. Woven refers to closely oriented by warp and filler strands at right angles to each other. Nonwoven refers to randomly integrated fibers or filaments. Suitable fabrics include woven or nonwoven cotton fabric, graphite fabric, fiberglass, woven or nonwoven polyimide (for example, KEVLAR™, available from DuPont), woven or nonwoven polyamide, such as nylon or polyphenylene isophthalamide (for example, NOMEX™, of E. I. DuPont of Wilmington, Del.), polyester, aramids, polycarbonate, polyacryl, polystyrene, polyethylene, polypropylene, cellulose, polysulfone, polyxylene, polyacetal, and the like, and mixtures thereof. The substrate may have a thickness of from about 1 to about 70 mm, such as from about 1 to about 30 mm, or from about 25 to about 55 mm, or from about 50 to about 70 mm.

The composition may be deposited on the substrate by any suitable process, such as draw-down coating, spray coating, spin coating, flow coating, dipping, spraying such as by multiple spray applications of very fine thin films, casting, web-coating, roll-coating, extrusion molding, laminating, or the like. The thickness of the surface coating may be from about 5 to about 500 microns thick, such as from about 5 to about 200 microns, or from about 150 to about 400 microns, or from about 300 to about 500 microns. The surface coating may be cured for a time period of from about 0.5 to about 6 hours, such as from about 0.5 to about 3 hours, or from about 1 to about 4 hours, or from about 3.5 to about 6 hours, at an appropriate temperature, such as from about 90° C. to about 200° C., or from about 90° C. to about 140° C., or from about 120° C. to about 180° C., or from about 150° C. to about 200° C.

Ink Materials

Any ink suitable for use in an indirect printing method may be used. Suitable ink compositions include curable inks, aqueous inks, and solvent inks. The ink composition may include a resin, colorants, waxes, and other additives. The term "ink composition" refers, for example, to all colors of a particular ink composition including, for example, usable color sets of an ink composition. For example, an ink composition may refer to a usable color set of phase change ink that includes cyan, magenta, yellow, and black inks. Therefore, as defined herein, cyan phase change ink and magenta phase change ink are different ink colors of the same ink composition.

Some ink compositions, referred to herein as curable inks, may be cured by the imaging device. As used herein, the process of "curing" ink refers to curable compounds in an ink undergoing an increase in molecular weight in response to being exposed to radiation. Exemplary processes for increasing the molecular weight of a curable compound include, for example, crosslinking and chain lengthening. Cured ink is suitable for document distribution, is resistant to smudging, and may be handled by a user. Radiation suitable to cure ink may encompass the full frequency (or wavelength) spectrum including, for example, microwaves, infrared, visible, ultraviolet, and x-rays. As used herein, the term "ultraviolet" radiation encompasses radiation having a wavelength of from about 50 nm to about 400 nm.

Any suitable resin may be used to from the ink composition. Suitable resins include polyester resins, including the resins described in U.S. Pat. Nos. 6,593,049 and 6,756,176, the entire disclosures of which are totally incorporated herein by reference. Suitable crystalline polyester resins include those known in the art, such as those disclosed in U.S. Pat. No. 8,192,913, the entire disclosure of which is totally incorporated herein by reference. Suitable crystalline polyester resins also include those disclosed in U.S. Pat. Nos. 7,329,476; 7,494,757; 7,968,266; 7,749,673; and 7,695,884, the entire disclosures of which are totally incorporate herein by reference. Suitable resins may also include a mixture of at least one amorphous polyester resin and a crystalline polyester resin, as described in U.S. Pat. No. 6,830,860, the entire disclosure of which is totally incorporated herein by reference Suitable colorants or pigments include pigment, dye, mixtures of pigment and dye, mixtures of pigments, mixtures of dyes, and the like. For simplicity, the term "colorant" refers to colorants, dyes, pigments, and mixtures, unless specified as a particular pigment or other colorant component. The colorant may comprise a pigment, a dye, mixtures thereof, carbon black, magnetite, black, cyan, magenta, yellow, red, green, blue, brown, and mixtures thereof, in an amount of about 0.1 to about 35 wt % based upon the total weight of the composition, such as from about 1 to about 25 wt %.

Suitable colorants include those known in the art, such as those disclosed in, for example, U.S. Pat. No. 8,192,913, the entire disclosure of which is totally incorporated herein by reference. The colorant may be present in the ink in an amount ranging from about 1 to about 35 wt % of the ink particles on a solids basis, such as from about 5 to about 25 wt %, or from about 5 to about 15 wt %.

An ink suitable for use in the above-described two-step printing process may have surface tension, viscosity, and particle size suitable for use in a piezoelectric inkjet printhead. For example, the surface tension of the jettable ink may be from about 15 to about 50 dynes/cm, such as from about 15 to about 30 dynes/cm, or from about 25 to about 40 dynes/cm, or from about 35 to about 50 dynes/cm. The viscosity of the jettable inks may be, for example, from about 1 to about 30 centipoise (cps) at 30° C., such as from about 1 to about 14 cps, or from about 8 to about 20 cps, or from about 16 to about 30 cps. The particle size of the jettable inks may be less than about 600 nm, such as less than about 300 nm, or less than about 150 nm.

EXAMPLES

The following Examples are intended to be illustrative only and are not intended to limit the scope of the present disclosure. Also, parts and percentages are by weight unless otherwise indicated.

Example 1

Blend Approach

An azobenzene/polymer mixture is prepared by mixing Part A of a commercially available, crosslinkable polydimethylsiloxane (PDMS) two component system with 20 wt % of an azobenzene polymer in tetrahydrofuran (THF). The polymer mixture is then mixed with the Part B PDMS curing agent in a ratio of 10:1 compared to the amount of Part A added. The ratio of Part A:azobenzene:Part B is 10:2:1. The mixture is degassed for 20 minutes and then stirred at 40° C. prior to a blanket coating preparation.

The polymer mixture is either (1) cast or (2) surface coated. Casting involves pouring the polymer mixture into a mold, then curing for 2-4 hours at 120° C. Surface coating may be carried out on a suitable substrate, such as silicone rubber or other elastomers, polyimide, cotton fibre layers, or the like, by methods such as draw-down coating, spray coating, spin coating, or flow coating, where the surface coating is 20-300 μm thick. The surface coated layer is also cured for 2-4 hours at 120° C.

Example 2

Surface Grafted Approach

A layer of photoactive material is grafted onto the surface of a low surface free energy blanket or film. The procedure for fabrication is similar to that described in Example 1, excluding azobenzene incorporation and excluding the THF solvent. In a second step, the previously made blanket is exposed to plasma treatment using a Harrick Plasma Cleaner/Sterilizer (model PDC-32G) for 10 min. This creates reactive hydroxyl (—OH) groups on the surface of the blanket suitable for surface grafting.

The photoactive group is grafted onto the —OH containing surface by the procedure disclosed in D. Yang et al., "Photon Control of Liquid Motion on Reversibly Photoresponsive Surfaces," *Langmuir,* 2007, 23, 10864-72.

The hydroxyl terminated surface is reacted with ADES siloxane, which is commercially available from Gelest, to create an amino terminated surface. For this, the hydroxyl containing surface created in the previous step is heated in reflux of toluene that contains ADES dissolved in toluene for several hours to obtain an amino (—$NH_2$) terminated surface. This surface is used to have grafted onto it either (A) a small molecule, or (B) a polymeric responsive material.

Example 2A

Small Molecule Grafting

The amino terminated surface is placed in toluene solution containing a suitable acyl chloride azobenzene derivative and a pyridine derivative as a base. The chemical reaction between the acyl chloride group and the amino group onto the surface of the blanket produces the azobenzene surface functionalized intermediate transfer member.

Example 2B

Polymer Grafting

The azobenzene polymer is grafted onto the amino terminated surface by linking it to the surface through the active —$NH_2$ groups, and the polymer chain is consequently grown on top of the surface. A suitable experimental procedure for the grafting process is based on that disclosed in T. Sun et al., "Reversible Switching Between Superhydrophilicity and Superhydrophobicity," *Angew. Chem. Int. Ed.* 2004m 43, 357-360.

Contact Angle Measurement

Contact angle (CA) measurements, such as those shown in Table 1 below, can verify the creation of hydroxyl groups, indicated by a switch from a hydrophobic surface to a hydrophilic surface upon plasma oxidation of PDMS for 10 min.

TABLE 1

| | Water CA | Literature Water CA (Anal. Chem., 2006, 78, 21, 7446) |
|---|---|---|
| Non-treated PDMS | ~109.4° ± 0.4° | 110.2° ± 2.3° |
| Plasma treated PDMS | <30° | 30.1° ± 1.9° |

Characterization

Characterization of the wetting properties can easily be done by measuring the water droplet contact angle after switching the surface in the two states.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. An intermediate transfer member comprising:

a blend of materials comprising:

a base polymer; and a stimulus-responsive additive, wherein the stimulus-responsive additive is responsive to light and is selected from the group consisting of azobenzenes, spiropyrans, triphenylmethyl derivatives, and cinnamoyl derivatives.

2. The intermediate transfer member of claim 1, wherein the base polymer has a surface free energy of from about 10 to about 25.

3. The intermediate transfer member of claim 1, wherein the base polymer is selected from the group consisting of fluorinated ethylene, fluorinated propylene, fluorosilicones, silicone rubbers, and fluoroelastomers.

4. The intermediate transfer member of claim 1, wherein:

the intermediate transfer member is in a first surface free energy state when illuminated with a UV light having a wavelength of from about 200 to about 400 nm;

the intermediate transfer member is in a second surface free energy state when illuminated with light having a wavelength of from about 400 to about 800 nm; and the first surface free energy state is higher than the second free energy state.

5. The intermediate transfer member of claim 1, wherein the lower surface free energy state is achieved by heating the intermediate transfer member at a temperature of from about 50° C. to about 200° C.

6. The intermediate transfer member of claim 1, wherein:

the polymer is present in the blend of materials in a range of from about 40 to about 99 wt % based on a total weight of the blend; and the stimulus-responsive additive is present in the blend in a range of from about 1 to about 60 wt % based on a total weight of the blend.

7. A printing apparatus comprising the intermediate transfer member of claim 1.

8. An intermediate transfer member comprising:

a first layer comprising a base polymer; and a second layer grafted onto the first layer and comprising a stimulus-responsive additive, wherein the stimulus-responsive additive is responsive to light and wherein the second layer comprises a responsive polymer fabricated from monomers selected from the group consisting of azobenzene switchable units, spiropyran switchable units, and units and of polymerizable groups which include vinyl groups.

9. The intermediate transfer member of claim 8, wherein the base polymer has a surface free energy of from about 10 to about 30 dyne/cm.

10. The intermediate transfer member of claim 8, wherein the second layer comprises an azobenzene polymer.

11. The intermediate transfer member of claim 8, wherein the first layer comprises a material selected from the group consisting of silicones, fluoropoylmers, specially fluorinated materials, and networked silioxyfluorocarbons.

12. A printing apparatus comprising the intermediate transfer member of claim 8.

13. A method of printing an image to a substrate comprising:

applying an ink onto an intermediate receiving member using an inkjet printhead;

spreading the ink onto the intermediate receiving member;

inducing a property change of the ink; and transferring the ink to a substrate, wherein the intermediate transfer member comprises a base polymer and a stimulus-responsive additive, wherein the stimulus-responsive additive is responsive to light and is selected from the group consisting of azobenzenes, spiropyrans, triphenylmethyl derivatives, and cinnamoyl derivatives.

14. The method of claim 13, wherein the stimulus-responsive additive is present in the intermediate transfer member in a blend of materials.

15. The method of claim 13, wherein:

the intermediate transfer member comprises a first layer and a second layer grafted onto the first layer;

the first layer comprises the polymer; and the second layer comprises the stimulus-responsive additive.

16. The method of claim 13, further comprising:

switching the intermediate transfer member from a first surface free energy state to a second surface free energy state by exposing the intermediate transfer member to a UV wavelength of from about 200 to about 400 nm; and reversibly switching the intermediate transfer member from the second surface free energy state to the first surface free energy state by exposing the intermediate transfer member to a light having a wavelength of from about 400 to about 800 nm.

* * * * *